US009359793B2

(12) United States Patent
Field et al.

(10) Patent No.: US 9,359,793 B2
(45) Date of Patent: Jun. 7, 2016

(54) CYLINDER LOCK WITH INTERNAL SLIDER AND KEY THEREFORE

(71) Applicant: MEDECO SECURITY LOCKS, INC., Salem, VA (US)

(72) Inventors: Peter H. Field, Salem, VA (US); Glenn Hartman, Salem, VA (US)

(73) Assignee: MEDECO SECURITY LOCKS, INC., Salem, VA (US)

( * ) Notice: Subject to any disclaimer, the term of this patent is extended or adjusted under 35 U.S.C. 154(b) by 0 days.

(21) Appl. No.: 14/504,838

(22) Filed: Oct. 2, 2014

(65) Prior Publication Data

US 2015/0096342 A1 Apr. 9, 2015
US 2015/0315814 A2 Nov. 5, 2015

Related U.S. Application Data

(60) Provisional application No. 61/886,388, filed on Oct. 3, 2013.

(51) Int. Cl.
*E05B 35/00* (2006.01)
*E05B 19/00* (2006.01)
*E05B 27/00* (2006.01)

(52) U.S. Cl.
CPC ..... *E05B 35/003* (2013.01); *E05B 19/00* (2013.01); *E05B 27/0003* (2013.01); *E05B 27/0082* (2013.01); *Y10T 70/7486* (2015.04)

(58) Field of Classification Search
CPC ..... E05B 27/0003; E05B 35/003; E05B 27/0082; E05B 19/00; E05B 19/0017; Y10T 70/7486
USPC ..... 70/398, 409, 491, 496
See application file for complete search history.

(56) References Cited

U.S. PATENT DOCUMENTS 947,913 A 2/1910 Jenkins
1,567,979 A 12/1925 Northrop (Continued)

FOREIGN PATENT DOCUMENTS

EP 0431550 A1 6/1991
EP 431550 A1 * 6/1991 ..... E05B 19/08

OTHER PUBLICATIONS

International Search Report and Written Opinion in International Patent Application No. PCT/US2014/058817, 10 pages (Dec. 18, 2014).

(Continued)

*Primary Examiner* — Lloyd Gall
*Assistant Examiner* — Amanda L Miller
(74) *Attorney, Agent, or Firm* — Rothwell, Figg, Ernst & Manbeck PC

(57) ABSTRACT

A lock and key combination includes a cylinder rotatably disposed within a shell and a sidebar within the cylinder and movable between a locked position preventing rotation of the cylinder and an unlocked position allowing rotation of the cylinder. A slider is mounted within the cylinder for movement between a first position blocking movement of sidebar from the locked position and a second position not blocking movement of said sidebar. A key has a blade configured to be inserted into a keyway of the cylinder and includes a slider-actuating element mounted within the blade for movement with respect to the blade. As the blade is inserted into the keyway, a cam element within the keyway moves the slider-actuating element to a position engaging the slider so that further movement of the key moves the slider from the first position to the second position.

13 Claims, 12 Drawing Sheets

(56) References Cited

U.S. PATENT DOCUMENTS

| | | | | | |
|---|---|---|---|---|---|
| 2,438,435 | A | | 3/1948 | Gagnon | |
| 2,440,428 | A | | 4/1948 | Best | |
| 3,486,355 | A | | 12/1969 | Halfyard | |
| 3,877,267 | A | * | 4/1975 | Harris, Jr. | 70/358 |
| 4,377,082 | A | * | 3/1983 | Wolter | 70/493 |
| 4,545,226 | A | | 10/1985 | Urrestarazu-Borda | |
| 4,662,200 | A | | 5/1987 | Borda | |
| 4,667,495 | A | * | 5/1987 | Girard et al. | 70/398 |
| 5,076,081 | A | | 12/1991 | Boris, Jr. | |
| 5,170,651 | A | * | 12/1992 | Errani | 70/493 |
| 5,437,176 | A | | 8/1995 | Keller | |
| 5,457,974 | A | | 10/1995 | Keller | |
| 5,520,035 | A | | 5/1996 | Eizen et al. | |
| 5,778,712 | A | | 7/1998 | Wallden | |
| 5,784,910 | A | | 7/1998 | Eizen et al. | |
| 5,839,308 | A | | 11/1998 | Eizen et al. | |
| 6,477,875 | B2 | * | 11/2002 | Field et al. | 70/491 |
| 6,681,609 | B1 | * | 1/2004 | Preddey | 70/495 |
| 6,945,082 | B2 | * | 9/2005 | Field et al. | 70/409 |
| 7,797,973 | B2 | | 9/2010 | Field et al. | |
| 9,157,256 | B2 | * | 10/2015 | Hiscocks | E05B 27/0003 |
| 2013/0298621 | A1 | * | 11/2013 | Clifford | 70/358 |

OTHER PUBLICATIONS

International Preliminary Report on Patentability issued in International Application No. PCT/US2014/058817, 8 pages (Apr. 14, 2016).

* cited by examiner

CYLINDER LOCK WITH INTERNAL SLIDER AND KEY THEREFORE

CROSS REFERENCE TO RELATED APPLICATION

This application claims the benefit under 35 U.S.C. §119 (e) of the filing date of provisional patent application Ser. No. 61/886,388 filed Oct. 3, 2013, the disclosure which is incorporated herein by reference.

FIELD OF THE INVENTION

This invention relates to a lock and key combination whereby, during insertion of the key into the lock, a moveable element within the key blade is moved into engagement with a slider to thereby move the slider and release an operatively interrelated sidebar from a locked position of the sidebar to an unlocked position.

BACKGROUND OF INVENTION

A cylinder lock includes a cylinder or plug rotatably disposed within a bore formed in a shell or housing. A keyway formed axially in the plug accepts a key having a blade shaped and warded to correspond to grooves and ridges of the keyway. Rotation of the cylinder within the shell may be controlled by one or more tumbler pin assemblies, whereby bitting formed on the key blade elevates each tumbler pin assembly to align the assembly with the shear line between the cylinder and the shell to enable the cylinder to rotate. As an alternative to tumbler pins or in addition to tumbler pins, a sidebar may be disposed in the cylinder and configured for radial movement relative to the cylinder. The sidebar includes knife edge that, when the sidebar is radially extended with respect to the cylinder, extends into an axial groove formed in the wall of the shell bore to prevent rotation of the cylinder. A slider is disposed within the cylinder and includes a sidebar-blocking portion that engages a corresponding portion of the sidebar to prevent the sidebar from moving radially inwardly and retracting from the axial groove. The slider includes a portion that extends into the keyway, and a properly configured key will contact the slider and, as the key is inserted into the keyway, will move the slider into a position whereby the corresponding blocking portions of the slider and the sidebar are not engaged, thereby enabling the sidebar to move radially inwardly to withdraw from the axial groove and permit the cylinder to rotate.

Exemplary locks and associated keys having various configurations of tumbler pins, sidebars, and sliders are described in U.S. Pat. Nos. 6,477,875; 6,945,082; and 7,797,973, the respective disclosures of which are hereby incorporated by reference.

SUMMARY OF THE INVENTION

Aspects of the invention are embodied in a lock and key combination that comprises a cylinder rotatably mounted within a shell and having a keyway formed therein. A sidebar is mounted within the cylinder for movement with respect to the cylinder between a locked position engaging the shell to prevent rotation of the cylinder with respect to the shell and an unlocked position disengaged from the shell so as to allow rotation of the cylinder with respect to the shell. A slider mounted within the cylinder and is configured for movement within the cylinder between a first position blocking movement of the sidebar from the locked position to the unlocked position and a second position not blocking movement of the sidebar from the locked position to the unlocked position. A key has a blade configured to be inserted into the keyway, and the blade includes a first side and a second side. The slider is mounted within the cylinder adjacent to a side of the keyway corresponding to the first side of the blade of a key inserted into the keyway. A slider-actuating element is mounted within the blade for movement with respect to the blade between a first position projecting from the first side of the blade and a second position projecting from the second side of the blade. A cam element within the keyway is configured to engage the slider-actuating element as the blade is inserted into the keyway and move the slider-actuating element to the first position whereby the slider-actuating element projects from the first side of the blade and engages the slider to move the slider from the first position blocking movement of the sidebar from the locked position to the unlocked position to the second position not blocking movement of the sidebar from the locked position to the unlocked position.

According to further aspects of the invention, the slider-actuating element comprises a pin disposed within a bore formed transversely through the keyway.

According to further aspects of the invention, the cam element comprises a ramp formed on a surface of the keyway that engages a portion of the slider-actuating element projecting from the second side of the blade when the slider-actuating element is in the second position and moves the slider-actuating element to the first position as the blade is inserted into the keyway.

According to further aspects of the invention, the slider includes a recess configured to receive a portion of the slider-actuating element projecting from the first side of the blade when the slider-actuating element is in the first position.

According to further aspects of the invention, the sidebar includes a knife-edge that extends into an groove formed in the shell when the sidebar is in the locked position and is withdrawn from the groove when the sidebar is in the unlocked position.

According to further aspects of the invention, the pin comprises a generally cylindrical pin having a collar of enlarged diameter surrounding an intermediate portion of the pin, thereby defining a first end and a second end on either side of the collar and having diameters that are less than the diameter of the collar.

According to further aspects of the invention, the pin comprises a generally cylindrical shank and an enlarged head at one end of the shank.

Other features and characteristics of the present invention, as well as the methods of operation, functions of related elements of structure and the combination of parts, and economies of manufacture, will become more apparent upon consideration of the following description and the appended claims with reference to the accompanying drawings, all of which form a part of this specification, wherein like reference numerals designate corresponding parts in the various figures.

BRIEF DESCRIPTION OF THE DRAWINGS

The accompanying drawings, which are incorporated herein and form part of the specification, illustrate various, non-limiting embodiments of the present invention. In the drawings, common reference numbers indicate identical or functionally similar elements.

DETAILED DESCRIPTION OF THE INVENTION

Figure 1:
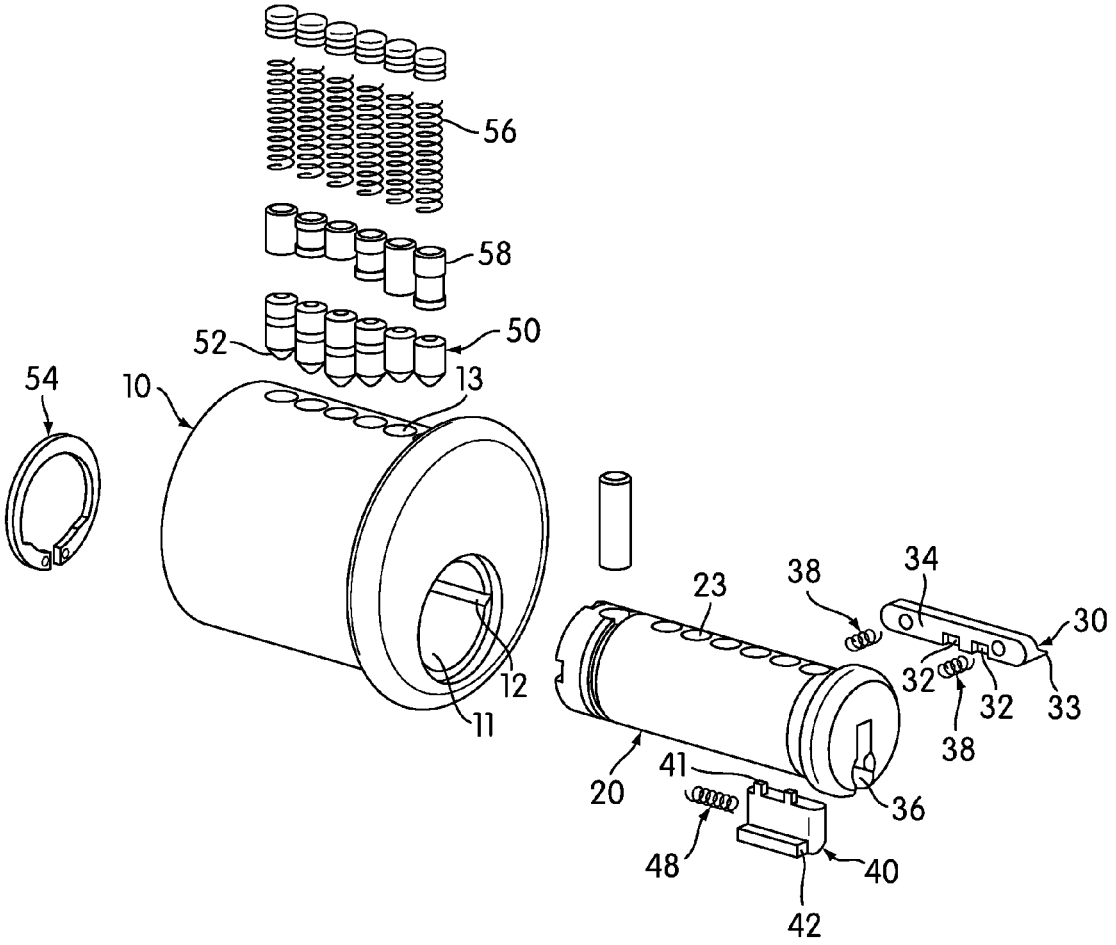
FIG. 1 PRIOR ART
FIG. 1 is an exploded perspective view of a prior art cylinder lock having a locking sidebar and a key-actuated slider for controlling the sidebar.

Unless defined otherwise, all terms of art, notations and other technical terms or terminology used herein have the same meaning as is commonly understood by one of ordinary skill in the art to which this disclosure belongs. All patents, applications, published applications and other publications referred to herein are incorporated by reference in their entirety. If a definition set forth in this section is contrary to or otherwise inconsistent with a definition set forth in the patents, applications, published applications, and other publications that are herein incorporated by reference, the definition set forth in this section prevails over the definition that is incorporated herein by reference.

Unless otherwise indicated or the context suggests otherwise, as used herein, "a" or "an" means "at least one" or "one or more."

This description may use relative spatial and/or orientation terms in describing the position and/or orientation of a component, apparatus, location, feature, or a portion thereof. Unless specifically stated, or otherwise dictated by the context of the description, such terms, including, without limitation, top, bottom, above, below, under, on top of, upper, lower, left of, right of, in front of, behind, next to, adjacent, between, horizontal, vertical, diagonal, longitudinal, transverse, etc., are used for convenience in referring to such component, apparatus, location, feature, or a portion thereof in the drawings and are not intended to be limiting.

Furthermore, unless otherwise stated, any specific dimensions mentioned in this description are merely representative of an exemplary implementation of a device embodying aspects of the invention and are not intended to be limiting.

FIG. 1 is an exploded, perspective view of a cylinder lock as disclosed in U.S. Pat. No. 7,797,973, showing the left hand side of the components. The lock includes a shell 10 having an axial bore 11 in which a cylindrical plug 20 fits and can rotate. The plug 20 is held in place by a retainer 54. In the plug 20 and the shell 10 are tumbler pin holes 23 and 13, respectively, in which pin sets or tumbler pin assemblies of various bottom pins 50, top pins 58, and springs 56 are positioned. The pins 50 have conical tips 52, and can be properly positioned to permit rotation of the plug 20 within the shell 10 merely by being elevated to align a shear line between the top pin 58 and bottom pin 50 of each pin set with a shear line between the plug 20 and the shell 10 by a key having the proper bitting pattern.

A sidebar 30 is positioned in a cavity formed in the side of the plug 20. The sidebar 30 has a beveled projection 33 with a knife edge that extends into an axial sidebar groove 12 formed in the sidewall of the axial bore 11 in the shell 10. The sidebar 30 is urged radially outwardly from the rotational axis of the plug 20, for example, by springs 38, so that the beveled projection 33 is urged into engagement with the sidebar groove 12. The plug 20 cannot be rotated to unlock the lock until the sidebar 30 is moved radially toward the rotational axis of the plug 20, and the beveled projection 33 is disengaged from the sidebar groove 12.

In the context of this disclosure, the term "engage"—or engages, engaged, engagement, engaging, or engageable—when referring to two more components or portions thereof means a direct or indirect physical or other cooperative interaction between the components or portions thereof that causes or facilitates a structural or functional result, such as coupling the components together, that would not occur but for the interaction between the components.

A slider 40 is positioned adjacent the sidebar 30 and has sidebar-blocking elements, such as at least one tab 41 that is engaged by a side 34 of the sidebar 30 to prevent the sidebar 30 from moving radially out of engagement from the sidebar groove 12. The slider 40 is biased axially, for example, by a spring 48, toward the front end of the plug 20. A proper key inserted into a keyway 36 has a projection that engages a contact surface 42 on the slider 40 to move the slider 40 axially so as to align slider opening(s) 32 formed in the side 34 of the sidebar with the tab(s) 41 of the slider 40.

As the plug 20 is turned under control of the key, the beveled projection 33 of the sidebar 30 moves in the sidebar groove 12, and this action forces the sidebar 30 to move radially into the plug 20. The radial movement of the sidebar 30 with respect to the slider 40 and the plug 20 is enabled by the alignment of the slider opening(s) 32 with the tab(s) 41.

Figure 2:
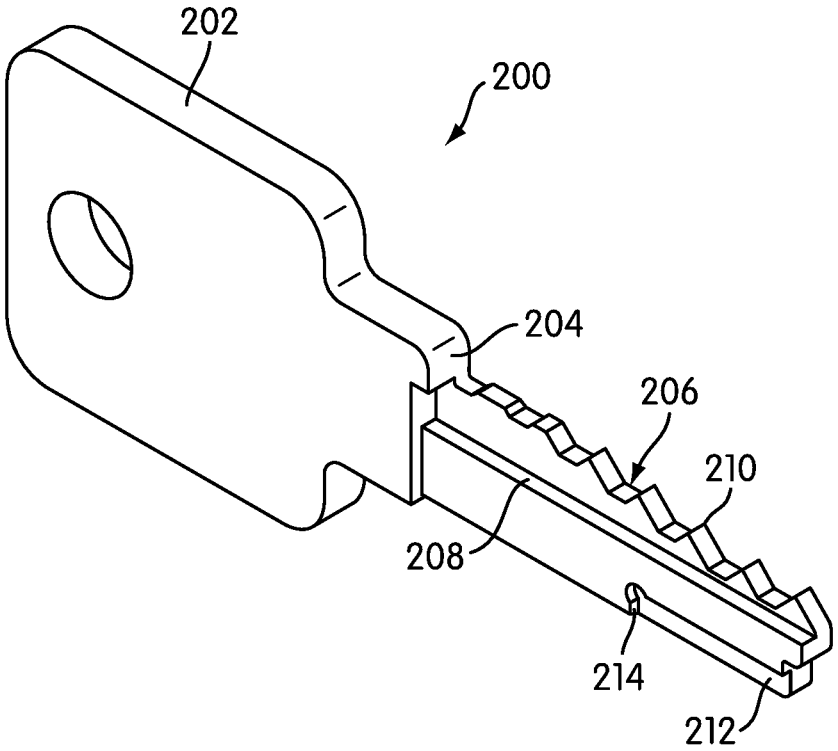
FIG. 2 PRIOR ART
FIG. 2 is a perspective view of a prior art key operable in a lock of the type shown in FIG. 1.
Figure 3A:
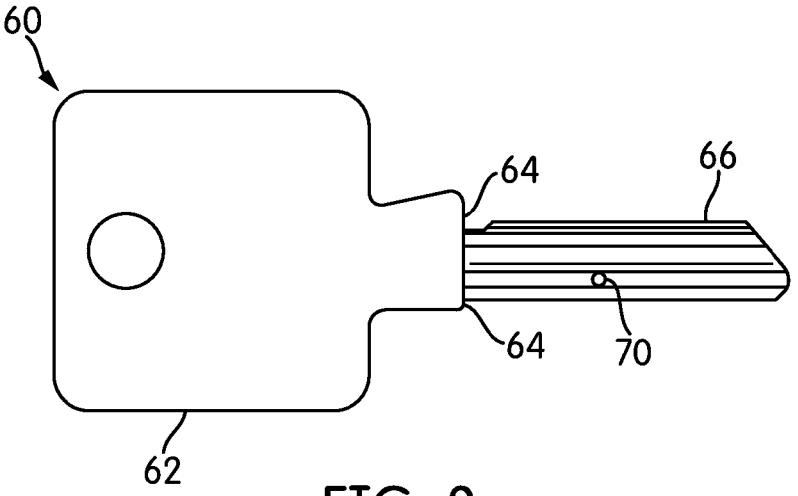
FIGS. 3*a-d* are a side view, a top view, a left end view, and a right end view, respectively, of a key embodying aspects of the invention.
Figure 3B:
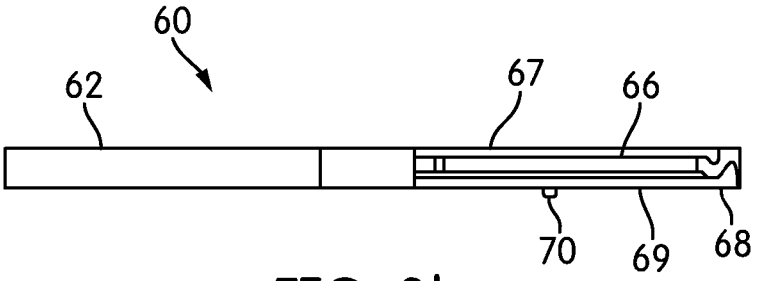
Figure 3C:
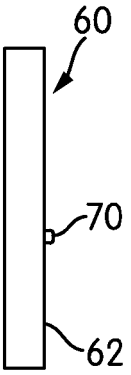
Figure 3D:
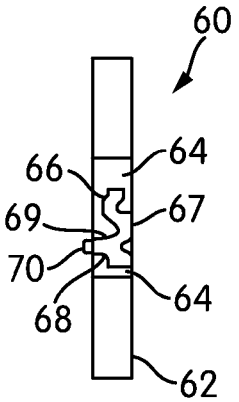

FIG. 2 shows a key 200 with a bow 202 and a shoulder or key stop 204 with a blade 206 extending from the key stop 204. Blade 206 includes bitting 210 and a profile, for example, defined by a longitudinal rib 208, which conforms to the keyway of a lock. Key 200 further includes a longitudinally extending cutout 212 having a contact surface 214 defined at an end thereof. The key 200 shown in FIG. 2 will operate a lock of the type shown in the FIG. 1. That is, the bitting 210 will elevate the tumbler assemblies 50, 58, 56, and the contact surface 214 will contact the projection 42 of the slider 40 and move the slider to a non-interfering position with respect to the sidebar 30.

FIGS. 3*a-d* are a side view, a top view, a left end view, and a right end view, respectively, of a key 60 embodying aspects of the present invention. The key 60 includes a bow 62 and a blade 66 with a shoulder 64 and a first side 67 and a second side 69. Note that the designation of the sides 67, 69 as "first" or "second" is merely for purposes of distinguishing one side of the blade 66 from the other and does not otherwise suggest any further limitations. The blade 66 may include various warding features, such as a longitudinal ridge 68 extending along all or part of the blade 66. Key 60 includes a slider-actuating element mounted within the blade 66 for movement with respect to the blade 66 between a first position projecting from the first side 67 of the blade 66 and a second position projecting from the second side 69 of the blade. In the illustrated embodiment, the slider-actuating element comprises a slider pin 70 disposed within a bore formed transversely through the blade 66 and is configured for partial transverse movement (i.e., into or out of the page of the drawing) relative to the blade 66 between a first position projecting from the first side 67 of the blade 66 and a second position projecting from the second side 69 of the blade.

Figure 5:
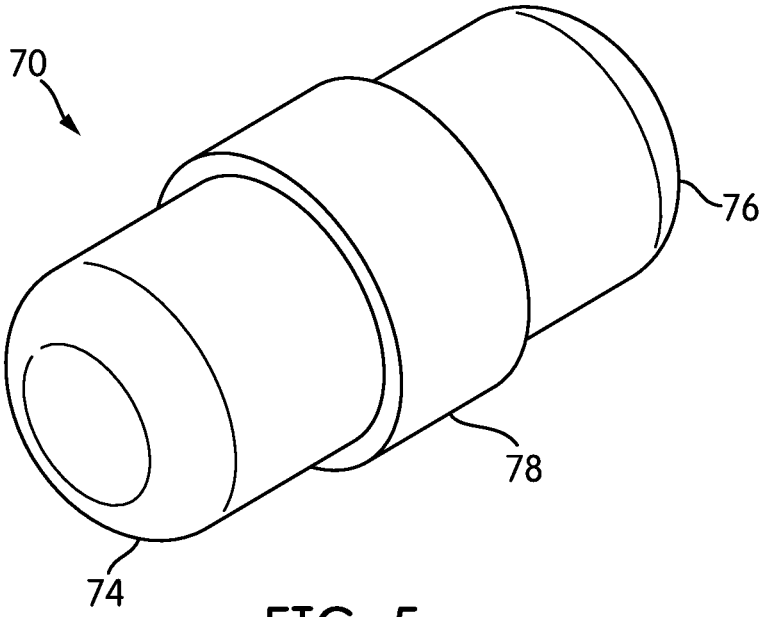
FIG. 5 is a perspective view of a slider pin.
Figure 6:
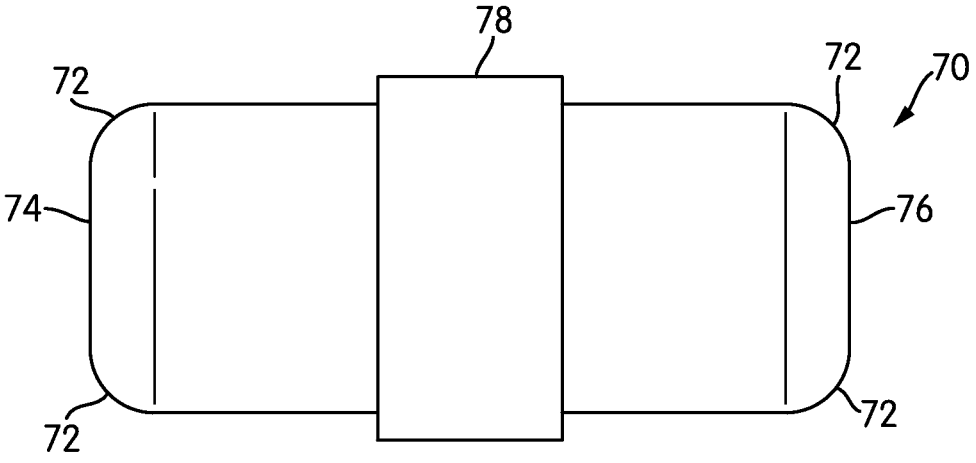
FIG. 6 is a side view of the slider pin.

FIG. 5 is a perspective view of the slider pin 70, and FIG. 6 is a side view of the slider pin 70. Slider pin 70 has a generally cylindrical configuration with a first tip 74 and a second tip 76. Note that the designation of the tips 74, 76 as "first" or "second" is merely for purposes of distinguishing one tip from the other and does not otherwise suggest any further limitations. The first and second tips 74,76 preferably have rounded corners 72. A collar 78 surrounds a midsection of the slider pin 70 and has a diameter that is greater than that of either the first tip 74 or the second tip 76. Collar 78 may be provided for retaining the slider pin 70 within a bore formed through the blade 66 of the key 60.

Figure 4A:
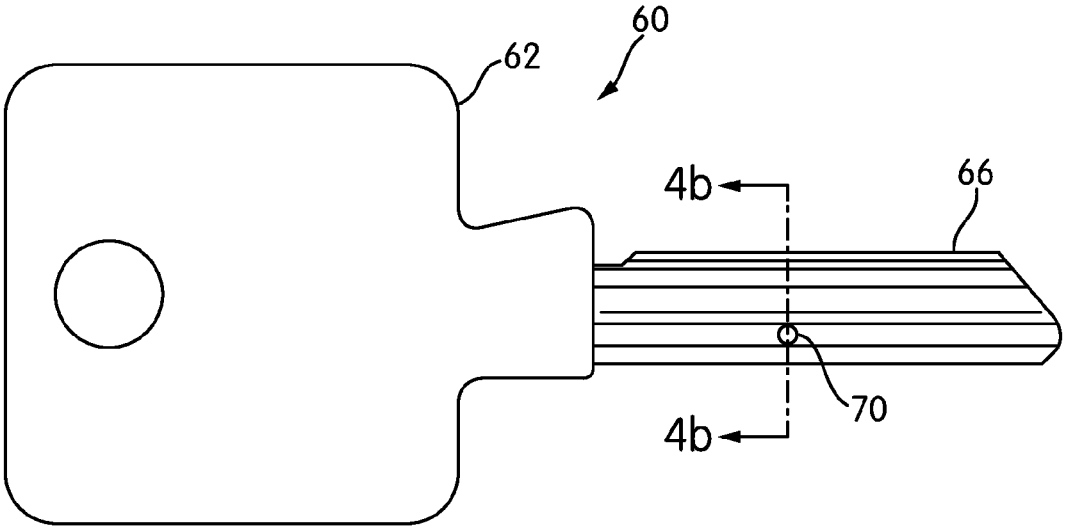
FIG. 4*a* is a side view of a key embodying aspects of the invention.
Figure 4B:
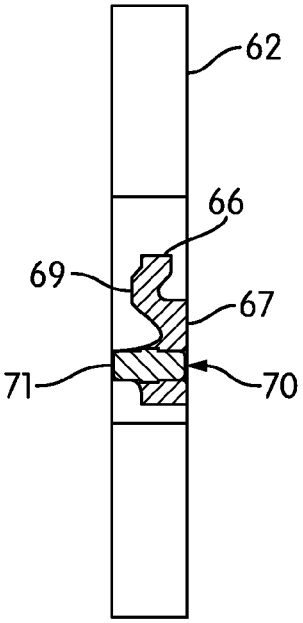
FIG. 4*b* is a cross-section of the key along the line 4*b*-4*b* in FIG. 4*a*.

FIG. 4*a* is a side view of the key 60, and FIG. 4*b* is a cross section of the key 60 along the line 4*b*-4*b* through the blade 66. FIG. 4*b* shows in further detail the slider pin 70 disposed for movement within a hole formed transversely through the blade 66 for movement between the first position projecting from the first side 67 of the blade 66 and the second position projecting from the second side 69 of the blade. In one embodiment, the hole has an internal diameter that is large enough to accommodate one side 74 or 76 of the slider pin 70, but is smaller than the diameter of the collar 78. A counter bore large enough to accommodate the collar 78 is then partially drilled into the first-made through hole from one side of the blade 66 (e.g., from side 69). The slider pin 70 is then placed into the counter-bored hole, and the hole is then staked at the end thereof from which the counter-bore was drilled (e.g., at 71). Staking provides an interference for the collar 78 to thereby retain the pin 70 within the key blade 66.

Figure 7:
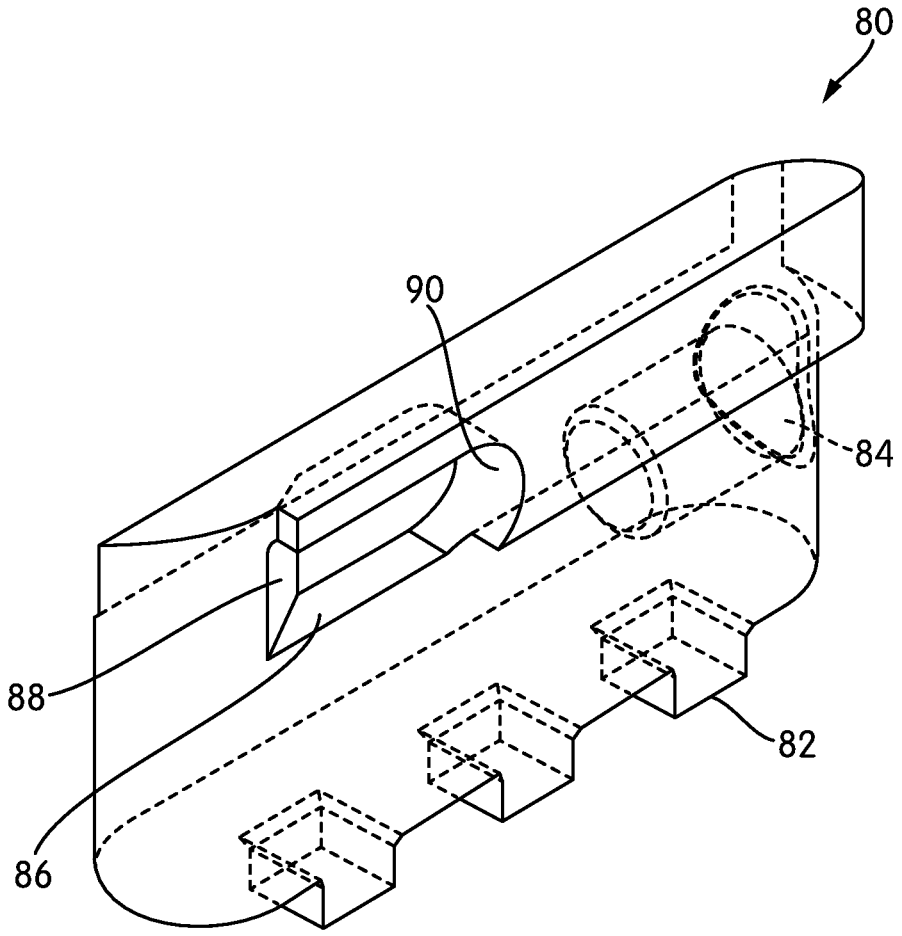
FIG. 7 is a perspective view of a slider embodying aspects of the invention.
Figure 8A:
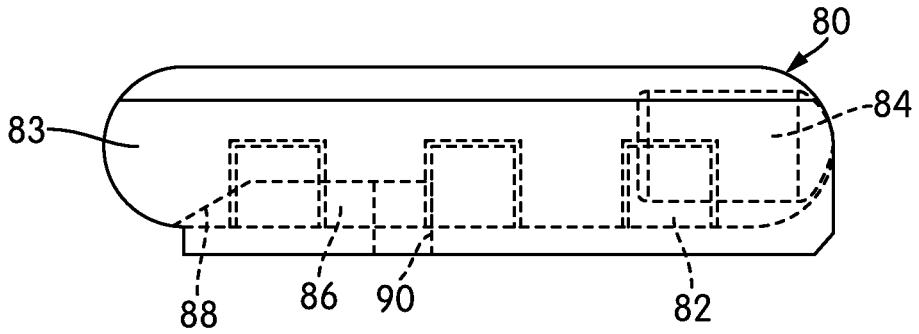
FIGS. 8*a-d* are a top view, a side view, a left-end view, and a right-end view, respectively, of the slider.
Figure 8B:
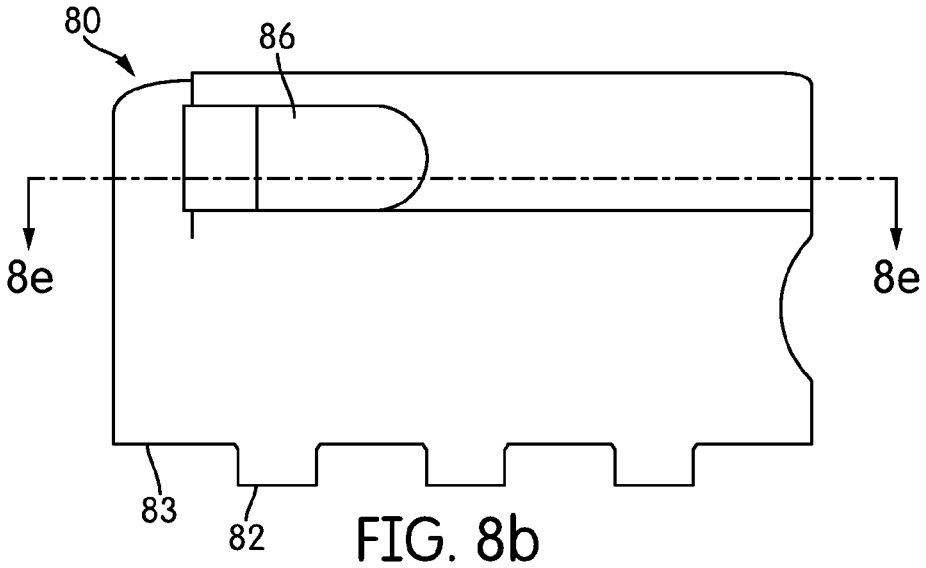
Figure 8C:
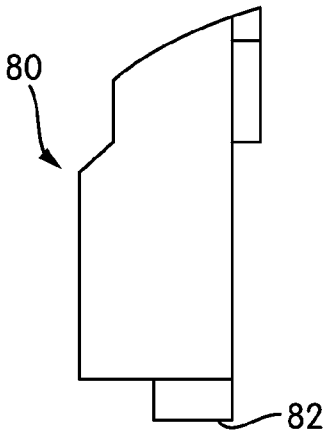
Figure 8D:
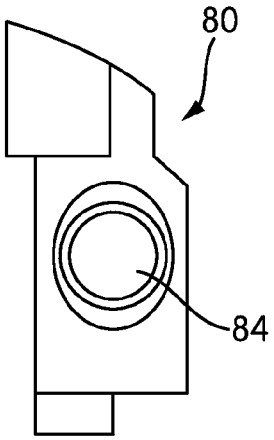
Figure 8E:
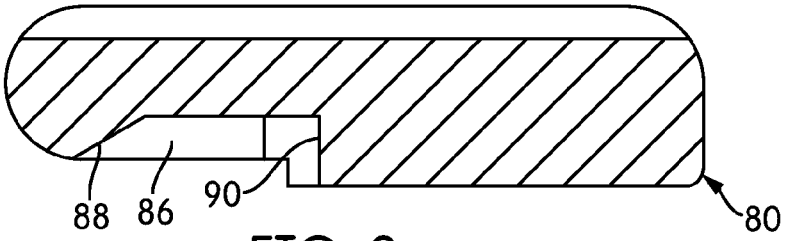
FIG. 8*e* is a cross section of the slider along the line 8*e*-8 *e*in FIG. 8*b*.

FIG. 7 is a perspective view of a slider 80 embodying aspects of the invention. FIG. 8*a* is a top view of the slider 80, FIG. 8*b* is a side view of the slider 80, FIG. 8*c* is a left-end view of the slider 80, and FIG. 8*d* is a right-end view of the slider 80. FIG. 8*e* is a cross section of the slider along the line 8*e*-8*e* in FIG. 8*b*. The slider 80 includes sidebar blocking portion(s), such as one or more tabs 82 extending from a bottom surface 83 of the slider 80. In the illustrated embodiment, the slider 80 includes three tabs 82. Slider 80 may further include a spring retainer bore 84 comprising a blind hole extending into the right end of the slider 80. A pin recess 86 is formed in a portion of the slider 80. Pin recess 86 extends transversely into the slider 80 and is elongated in a direction corresponding to an axial direction of the cylinder in which the slider is installed. Recess 86 includes a first end comprising a ramp or angled surface 88 and a second end comprising an end surface 90.

FIGS. 9-12 illustrate the operation of the key 60 with the slider pin 70 that engages slider 80 within a lock.

Figure 9A:
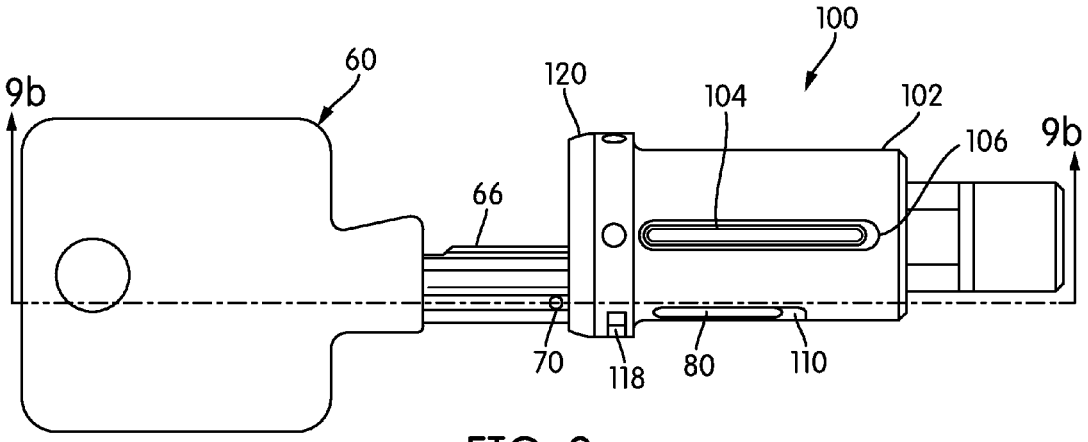
FIG. 9*a* is a side view of a lock embodying aspects of the present invention with a key partially inserted therein.
Figure 9B:
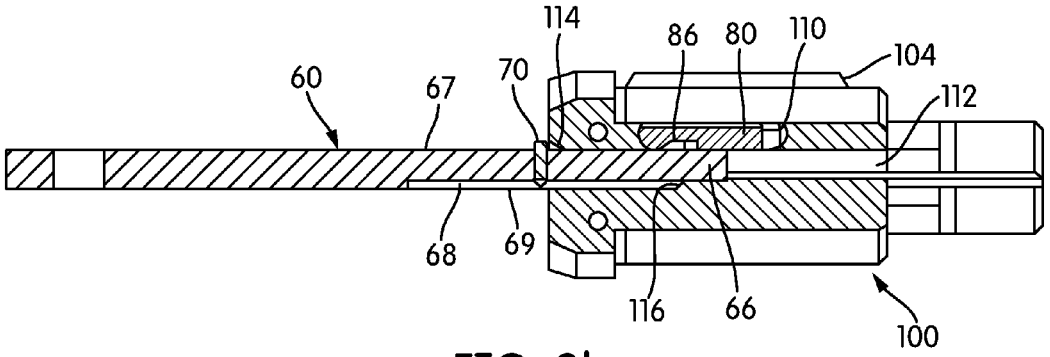
FIG. 9*b* is a cross section of the lock and key along the line 9*b*-9*b* in FIG. 9*a*.

FIG. 9*a* is a side view of a lock 100 embodying aspects of the invention with a key 60 partially inserted therein. Lock 100 includes a plug or cylinder 102 with a keyway 112 formed therein. A locking sidebar 104 extends axially along the cylinder 102 within a sidebar opening 106 formed in the plug 102. As shown in FIG. 9*b*, which is a cross section of the lock 100 and key 60 along the line 9*b*-9*b* in FIG. 9*a*, the slider 80 is disposed within a slider slot 110 formed in the cylinder 102 adjacent to the keyway 112.

Figure 9C:
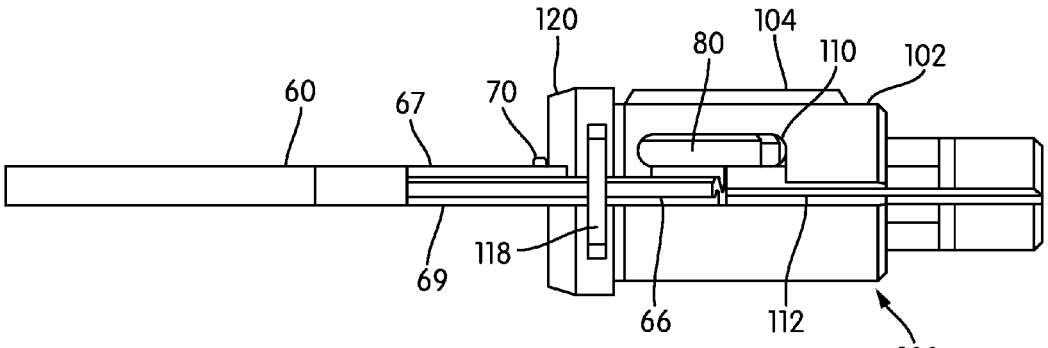
FIG. 9*c* is a bottom view of the lock and key shown in FIG. 9*a*.
Figure 13:
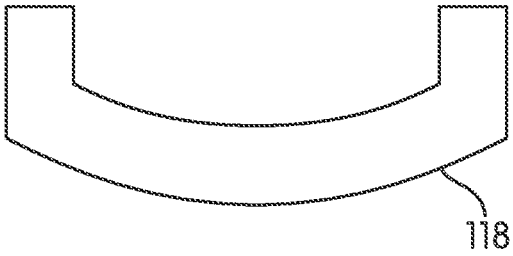
FIG. 13 is a plan view of a key guide plate for a lock embodying aspects of the present invention.

As shown in FIG. 9*c*, which is a bottom view of the lock 100 and key 60, a key guide 118 is disposed within a slot formed in a head 120 of the cylinder 102 along a bottom portion of the keyway 112 to support the key within the keyway, which is normally open along its bottom edge, and to align the key with the keyway. Further details of an embodiment of a key guide are shown in FIG. 13. The key guide 118 is optional and may be omitted in certain embodiments.

FIGS. 9*a-c* show the lock 100 with a key blade 66 of the key 60 partially inserted into the keyway 112. A portion of the slider pin 70 (e.g., a portion of the first tip 74 (see FIGS. 5, 6)) is extending from the first side 67 of the blade 66. The blade 66 is inserted into the keyway 112 to a point where the slider pin 70 has reached the entrance of the keyway 112. The entrance to the keyway 112 preferably includes an angle or bevel 114 for urging the slider pin 70 into the blade 66 to facilitate insertion of the blade 66 with the slider pin 70 projecting therefrom into the keyway 112.

Figure 10A:
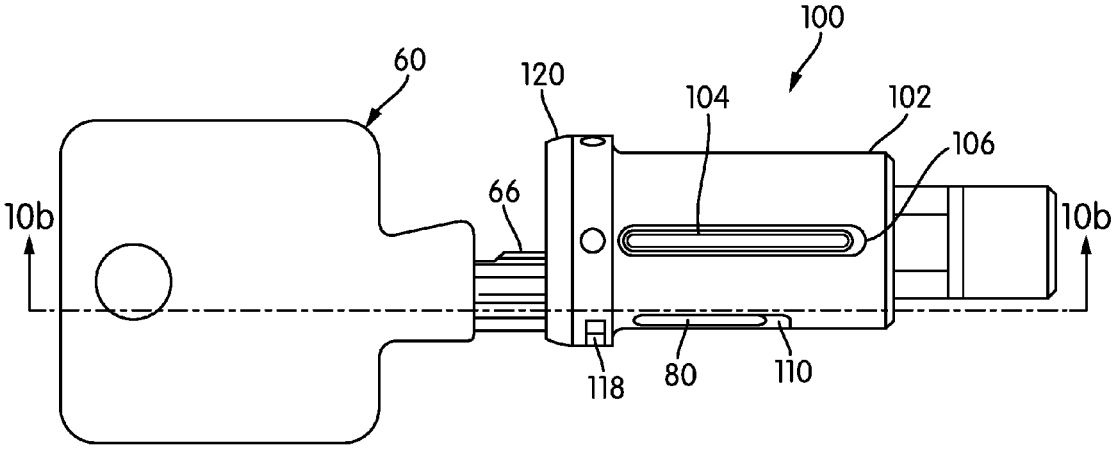
FIG. 10*a* is a side view of the lock with the key partially inserted therein to a further position than shown in FIG. 9*a*.
Figure 10B:
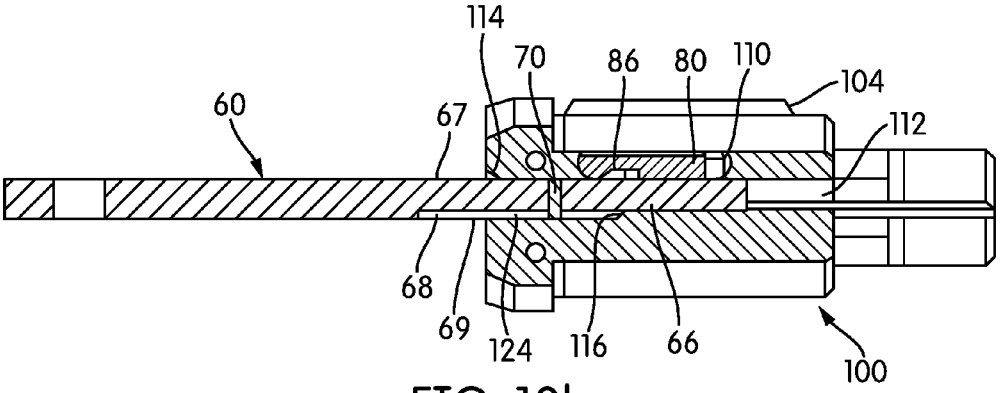
FIG. 10*b* is a cross section of the lock and key along the line 10*b*-10*b* in FIG. 10*a*.
Figure 10C:
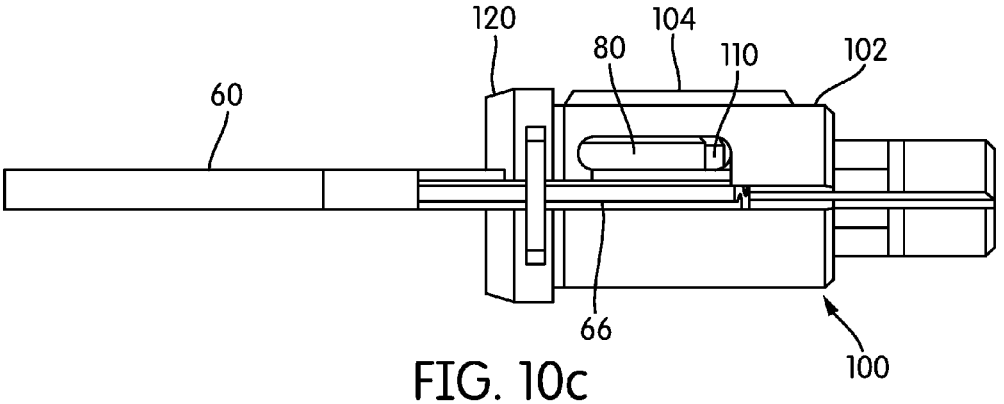
FIG. 10*c* is a bottom view of the lock and key shown in FIG. 10*a*.

FIGS. 10*a-c* are similar to FIGS. 9*a-c* but show the key blade 66 further inserted into the keyway 112. The blade 66 is now inserted into the keyway 112 such that the slider pin 70 is located within the keyway. The angled entrance 114 of the keyway 112 urges the slider pin 70 transversely within the blade 66 so that the pin 70 is retained within the keyway 112 and a portion of the slider pin 70 (e.g., a portion of the second tip 76) extends from second side 69 of the blade 66 into a section 124 of the keyway at which a rib on the keyway wall has been partially removed.

Figure 11A:
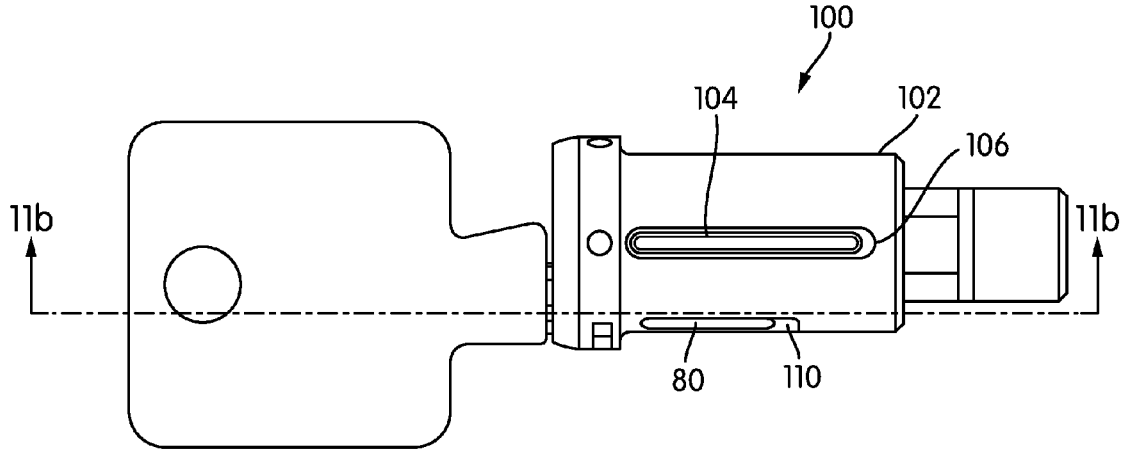
FIG. 11*a* is a side view of the lock with the key partially inserted therein to a further position than shown in FIG. 10*a*.
Figure 11B:
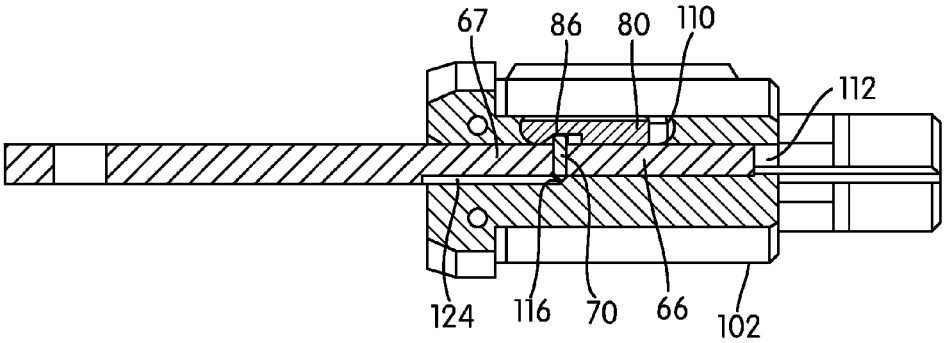
FIG. 11*b* is a cross section of the lock and key along the line 11*b*-11*b* in FIG. 11*a*.
Figure 11C:
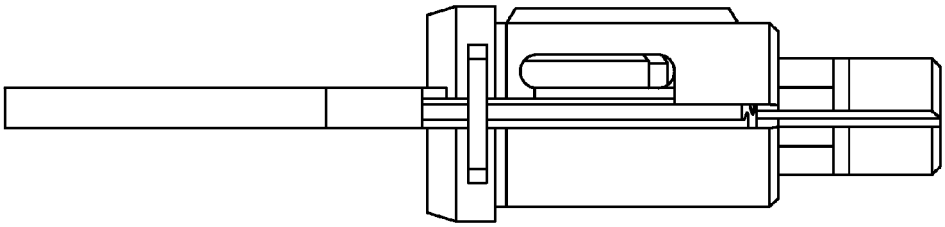
FIG. 11*c* is a bottom view of the lock and key shown in FIG. 11*a*.

FIGS. 11*a-c* are similar to FIGS. 9*a-c* and 10*a-c*, but show the key blade 66 even further inserted into the cylinder 102. As the key blade 66 is further inserted into the keyway 112, the portion of the slider pin 70 projecting from the second side 69 of the blade 66 encounters a cam element within the keyway 112 that pushes the slider pin 70 back through the key blade 66 so that a portion of the slider pin 70 extends from the first side 67 of the blade 66 to engage the slider 80. The slider 80 is mounted within the cylinder 102 adjacent to a side of the keyway 112 corresponding to the first side 67 of the blade 66 of the key 60. In the illustrated embodiment, the pin engages the slider 80 by extending into the pin recess 86. In the illustrated embodiment, as shown in FIG. 11*b*, the cam element comprises a ramp 116. The slider pin 70 engages the ramp 116, which is formed within the keyway 112 at the end of the section 124 at which a rib has been partially removed, to thereby urge the slider pin 70 transversely through the key blade 66 so that a portion of the pin extend from the first side 67 of the blade 66 and into the pin recess 86 of the slider 80. The ramp 88 formed on a first-end of the pin recess 86, where the slider pin 70 enters the pin recess 86, eases the transverse movement of the pin 70 into the pin recess 86.

Figure 12A:
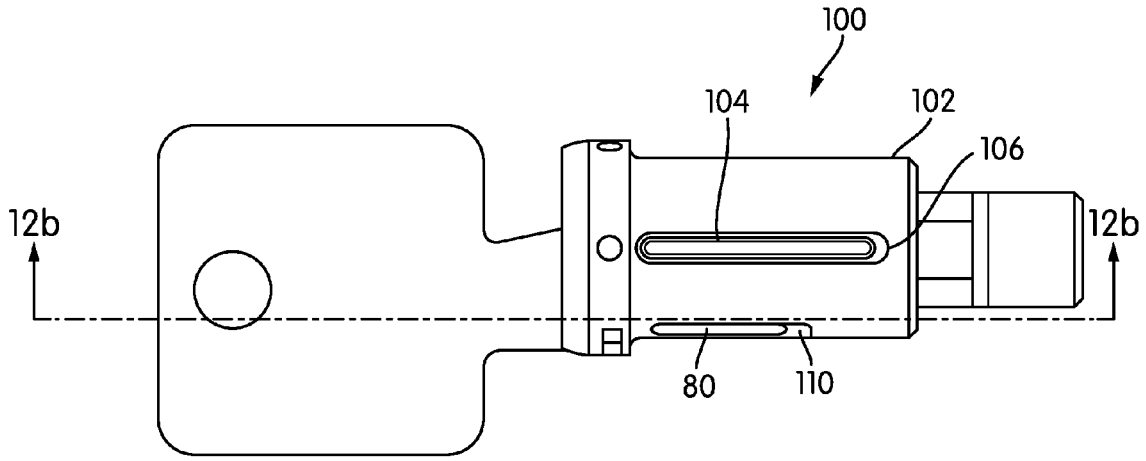
FIG. 12*a* is a side view of the lock with the key fully inserted therein.
Figure 12B:
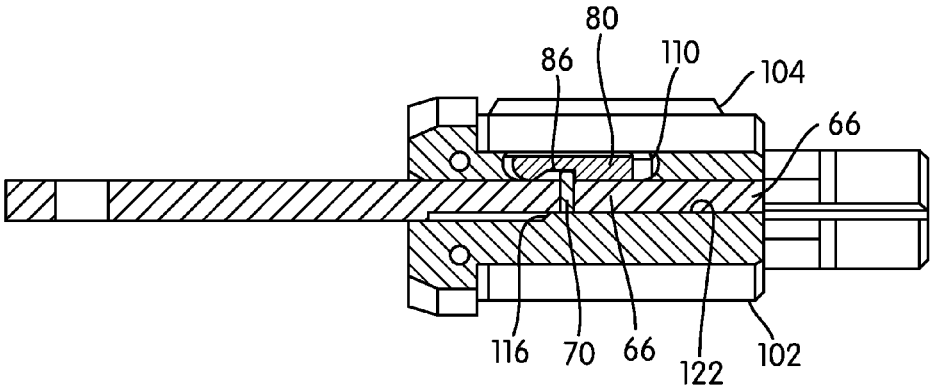
FIG. 12*b* is a cross section of the lock and key along the line 12*b*-12*b* in FIG. 12*a*.
Figure 12C:
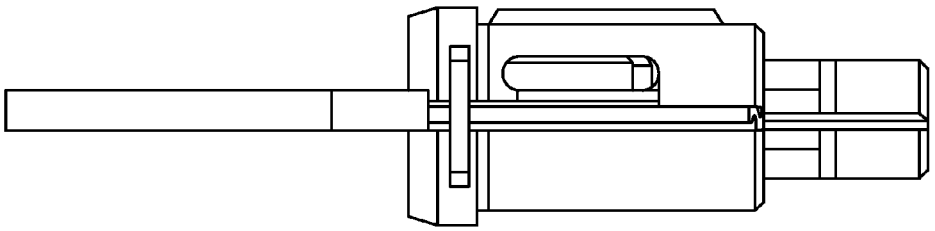
FIG. 12*c* is a bottom view of the lock and key shown in FIG. 12*a*.

As shown in FIGS. 12*a*-*c*, and particularly in FIG. 12*b*, which is a cross section of the lock 100 and key 60 along the line 12*b*-12b of FIG. 12*a*, as the key blade 66 is fully inserted into the plug 102, the slider pin 70 is now inserted into the pin recess 86 of the slider 80 by the sidewall or rib 122 of the keyway 112 engages the end surface 90 of the pin recess 86. Thus, the slide pin 70 and key 60 push the slider 80, e.g., against the bias of a spring disposed within the spring retainer 84, to the right in FIG. 12, to a position at which the slider 80 does not interfere with the sidebar 104. For example, at that position, the tabs 82 of the slider 80 and the corresponding structures of the sidebar 104, e.g., pockets or recesses that receive the tabs 82 (see slider opening(s) 32 formed in the sidebar 30 of FIG. 1), are constructed and arranged so as to permit the sidebar 104 to move radially inwardly with respect to the plug 102 to thereby release the plug 102 and permit its rotation within a shell (not shown in the drawing).

Figure 14:
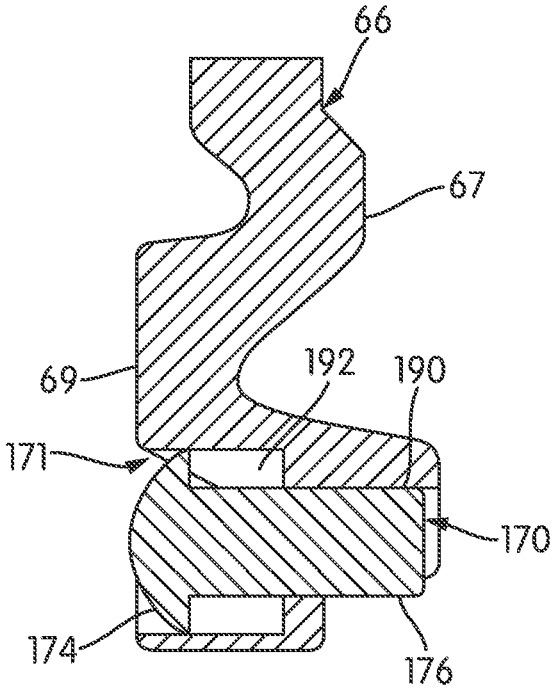
FIG. 14 is a cross-section of a key along the line 4*b*-4*b* in FIG. 4*a* showing an alternative embodiment of a slider pin.

FIG. 14, which is a cross-section of a key along the line 4*b*-4b in FIG. 4*a*, shows an alternative embodiment of a slider pin 170. The pin 170 comprises a shank 176, which may be generally cylindrical in shape, and an enlarged head 174. Pin 170 resides in a transverse through-hole formed in the blade 66. In one embodiment, the hole has an internal width or diameter 190 that is large enough to accommodate the shank 176 of the slider pin 170, but is smaller than the width or diameter of the head 174. A counter-bore 192, large enough to accommodate the head 174, is partially drilled into the first-made through-hole 192 from one side of the blade 66 (e.g., from side 69). The slider pin 170 is then placed into the hole as shown in FIG. 14, and the hole is then staked at the end thereof from which the counter-bore 192 was drilled (e.g., at 171). Staking the hole provides an interference for the head 174 to thereby retain the pin 170 within the key blade 66.

While the subject matter of this disclosure has been described and shown in considerable detail with reference to certain illustrative embodiments, including various combinations and sub-combinations of features, those skilled in the art will readily appreciate other embodiments and variations and modifications thereof as encompassed within the scope of the present invention. Moreover, the descriptions of such embodiments, combinations, and sub-combinations is not intended to convey that the inventions requires features or combinations of features other than those expressly recited in the claims. Accordingly, the scope of this disclosure is intended to include all modifications and variations encompassed within the scope of the following appended claims.

The invention claimed is:

1. A lock and key combination comprising:

a cylinder rotatably mounted within a shell and having a keyway formed therein;

a sidebar mounted within said cylinder and configured for movement with respect to said cylinder between a locked position engaging said shell to prevent rotation of said cylinder with respect to said shell and an unlocked position disengaged from said shell so as to allow rotation of said cylinder with respect to said shell;

a slider mounted within said cylinder and configured for movement within said cylinder between a first position blocking movement of said sidebar from the locked position to the unlocked position and a second position not blocking movement of said sidebar from the locked position to the unlocked position, wherein the slider is configured to move axially with respect to the cylinder between its first and second positions;

a key having a blade configured to be inserted into said keyway, said blade including a first side and a second side, wherein said slider is mounted within said cylinder adjacent to a side of the keyway corresponding to the first side of the blade of the key inserted into the keyway;

a slider-actuating element mounted within said blade for movement with respect to said blade between a first position projecting from the first side of said blade and a second position projecting from the second side of said blade, wherein the slider-actuating element comprises a pin disposed within a bore formed transversely through the key blade; and a cam element within the keyway and configured to engage the slider-actuating element as said blade is inserted into the keyway and move the slider-actuating element to the first position whereby the slider-actuating element projects from the first side of said blade and engages said slider to move said slider from the first position blocking movement of said sidebar from the locked position to the unlocked position to the second position not blocking movement of said sidebar from the locked position to the unlocked position.

2. The lock and key combination of claim 1, wherein the cam element comprises a ramp formed on a surface of the keyway that engages a portion of the slider-actuating element projecting from the second side of said blade when the slider-actuating element is in the second position and moves the slider-actuating element to the first position as the blade is inserted into the keyway.

3. The lock and key combination of claims 1, wherein said slider includes a recess configured to receive a portion of the slider-actuating element projecting from the first side of said blade when said slider-actuating element is in the first position.

4. The lock and key combination of claim 1, wherein said sidebar includes a knife-edge that extends into an groove formed in the shell when the sidebar is in the locked position and is withdrawn from the groove when the sidebar is in the unlocked position.

5. The lock and key combination of claim 1, wherein the pin comprises a generally cylindrical pin having a collar of enlarged diameter surrounding an intermediate portion of the pin, thereby defining a first end and a second end on either side of said collar and having diameters that are less than the diameter of the collar.

6. The lock and key combination of claim 1, wherein the pin comprises a generally cylindrical shank and an enlarged head at one end of the shank.

7. The lock and key combination of claim 1, further comprising one or more tumbler pin assemblies, each disposed within aligned tumbler pin holes formed in the cylinder and the shell, wherein each tumbler pin assembly is configured to be properly positioned to permit rotation of the cylinder within the shell by being elevated by the key having a proper bitting pattern to align a shear line of the tumbler pin assembly with a shear line between the cylinder and the shell.

8. The lock and key combination of claim 1, further comprising a spring configured to bias the sidebar into its locked position.

9. The lock and key combination of claim 1, further comprising a spring configured to bias the slider into its first position.

10. The lock and key combination of claim 1, wherein the sidebar is configured to move radially with respect to the axis of rotation of the cylinder between its locked and unlocked positions.

11. The lock and key combination of claim 1, wherein the slider includes one or more tabs and the sidebar includes one or more corresponding recesses, each configured to receive one of the tabs, wherein when the slider is in the first position, the tab(s) of the slider is(are) not aligned with the corresponding recess(es) of the sidebar, so that that movement of the sidebar from the locked position to the unlocked position is blocked by the tab(s), and when the slider is in the second position, the tab(s) of the slider is(are) aligned with the corresponding recess(es) of the sidebar, so the sidebar can move from the locked position to the unlocked position as the tab(s) enter the corresponding recess(es).

12. The lock and key arrangement of claim 1, wherein the key further comprises a bow and a shoulder.

13. The lock and key arrangement of claim 3, wherein the slider further includes an angled surface formed at one end of the recess.

* * * * *